US006776106B2

(12) United States Patent
Lin

(10) Patent No.: US 6,776,106 B2
(45) Date of Patent: Aug. 17, 2004

(54) WORKTABLE HAVING STABLY SUPPORTING LEG

(76) Inventor: Ming Mo Lin, P.O. Box 63-298, Taichung (TW), 406

( * ) Notice: Subject to any disclaimer, the term of this patent is extended or adjusted under 35 U.S.C. 154(b) by 6 days.

(21) Appl. No.: 10/287,736

(22) Filed: Nov. 1, 2002

(65) Prior Publication Data

US 2004/0083934 A1 May 6, 2004

(51) Int. Cl.[7] ..... A47B 3/06
(52) U.S. Cl. ..... 108/157.1; 108/156
(58) Field of Search ..... 108/153.1, 156, 108/157.16, 157.18, 158.11, 157.1, 155, 158, 158.12, 159.11, 157.17, 157.15; 248/188, 188.1, 188.8

(56) References Cited

U.S. PATENT DOCUMENTS 1,094,900 A * 4/1914 Holt ..... 403/264
3,063,765 A * 11/1962 Huff ..... 248/188.8
3,267,888 A * 8/1966 Carlson ..... 108/158
3,406,935 A * 10/1968 Mutchnik et al. ..... 248/188
3,530,804 A * 9/1970 Broome ..... 108/156
3,874,511 A * 4/1975 Maslow ..... 211/153
4,011,821 A * 3/1977 Neal ..... 108/156
4,925,140 A * 5/1990 Camarota ..... 248/188
5,165,349 A 11/1992 McAllister
6,241,108 B1 * 6/2001 Nakatani et al. ..... 211/187

FOREIGN PATENT DOCUMENTS

DE 3838304 * 5/1990
GB 2263230 * 7/1993

* cited by examiner

*Primary Examiner*—Jose V. Chen

(57) ABSTRACT

A worktable includes a housing secured to bottom of a table top and having a chamber formed by two side walls and a bottom panel and having one or more orifices formed in the bottom panel by peripheral fences. One or more plates are secured between the side walls of the housing, and each has an aperture formed by a peripheral fence and aligned with the orifice of the housing for receiving a leg. A sleeve is engaged between the leg and the housing and the plate with a wedge action, for stably securing the leg to the table top with the housing without fasteners.

14 Claims, 7 Drawing Sheets

WORKTABLE HAVING STABLY SUPPORTING LEG

BACKGROUND OF THE INVENTION

1. Field of the Invention

The present invention relates to a worktable, and more particularly to a worktable including a table top having one or more stably supporting legs attached thereto for stably supporting the worktable.

2. Description of the Prior Art

Various kinds of typical worktables have been developed for supporting tools or workers or the like. One of the typical worktables is disclosed in U.S. Pat. No. 5,165,349 to McAllister and comprises a number of recessed leg supporting gussets for stably supporting the table top of the worktable.

However, the supporting gussets includes a back-up plate secured in an inverted hat-shaped channel frame with such as a welding processes. However, a number of welding spots or portions are required to be provided or formed between the back-up plate and the channel frame. In addition, a tiny space may be formed between the back-up plate and the channel frame, such that the back-up plate and the channel frame may not be easily secured and welded together, or the welding tools may not be easily engaged into the tiny space formed between the back-up plate and the channel frame.

The present invention has arisen to mitigate and/or obviate the afore-described disadvantages of the conventional worktables.

SUMMARY OF THE INVENTION

The primary objective of the present invention is to provide a worktable including one or more stably supporting legs attached thereto for stably supporting the worktable.

The other objective of the present invention is to provide a worktable including a stable structure for allowing the supporting legs to be easily and quickly and solidly secured onto the worktable.

In accordance with one aspect of the invention, there is provided a worktable comprising a table top, a housing secured to bottom of the table top, and including a chamber formed therein and defined by a pair of side walls and a bottom panel, the housing including at least one orifice formed in the bottom panel thereof, at least one plate received in the chamber of the housing, and secured between the side walls of the housing, and including an aperture formed therein and aligned with the orifice of the housing, at least one leg including an end portion engaged into the orifice of the housing and the aperture of the plate, and at least one sleeve engaged between the end portion of the leg and the housing and the plate, for detachably stably securing the leg to the table top with the housing without fasteners. The sleeve may be wedged between the leg and the housing and the plate.

The plate includes two side flaps extended therefrom and secured to the side walls of the housing, and may further include a peripheral fence extended therefrom for forming and defining the aperture thereof and for engaging with the sleeve.

The peripheral fence of the plate includes an inclination for engaging with the sleeve. The sleeve may also include an inclined outer peripheral surface for engaging with the peripheral fence of the plate.

The housing includes a peripheral fence extended from the bottom panel thereof for forming and defining the orifice thereof and for engaging with the sleeve. The peripheral fence of the housing includes an inclination for engaging with the sleeve. The sleeve may also include an inclined outer peripheral surface for engaging with the peripheral fence of the housing.

The housing includes two open ends, and includes two end panels extended therefrom for enclosing the open ends of the housing.

The end portion of the leg includes at least one groove formed therein, the sleeve includes at least one rib extended therefrom and engaged into the groove of the leg for preventing the sleeve from moving relative to the leg.

One or more fasteners may further be provided for solidly fastening the sleeve to the housing. The sleeve includes two sleeve casings engaged with each other for forming a cylindrical sleeve.

A first of the sleeve casings includes at least one recess formed therein, and a second of the sleeve casings includes at least one ear extended therefrom and engaged into the recess of the first sleeve casing, for preventing the first and the second sleeve casings from moving relative to each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
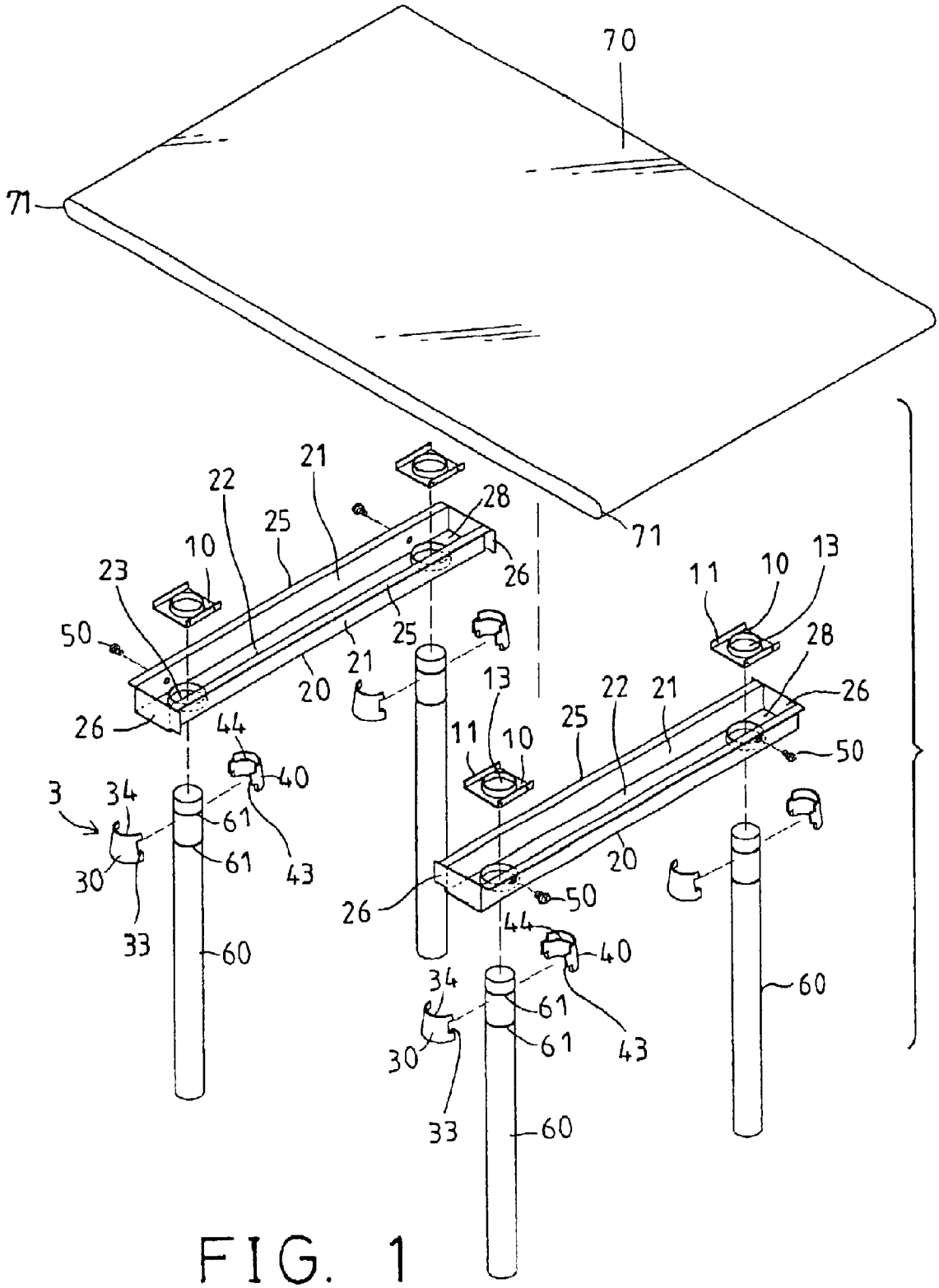
FIG. 1 is an exploded view of a worktable in accordance with the present invention.
Figure 2:
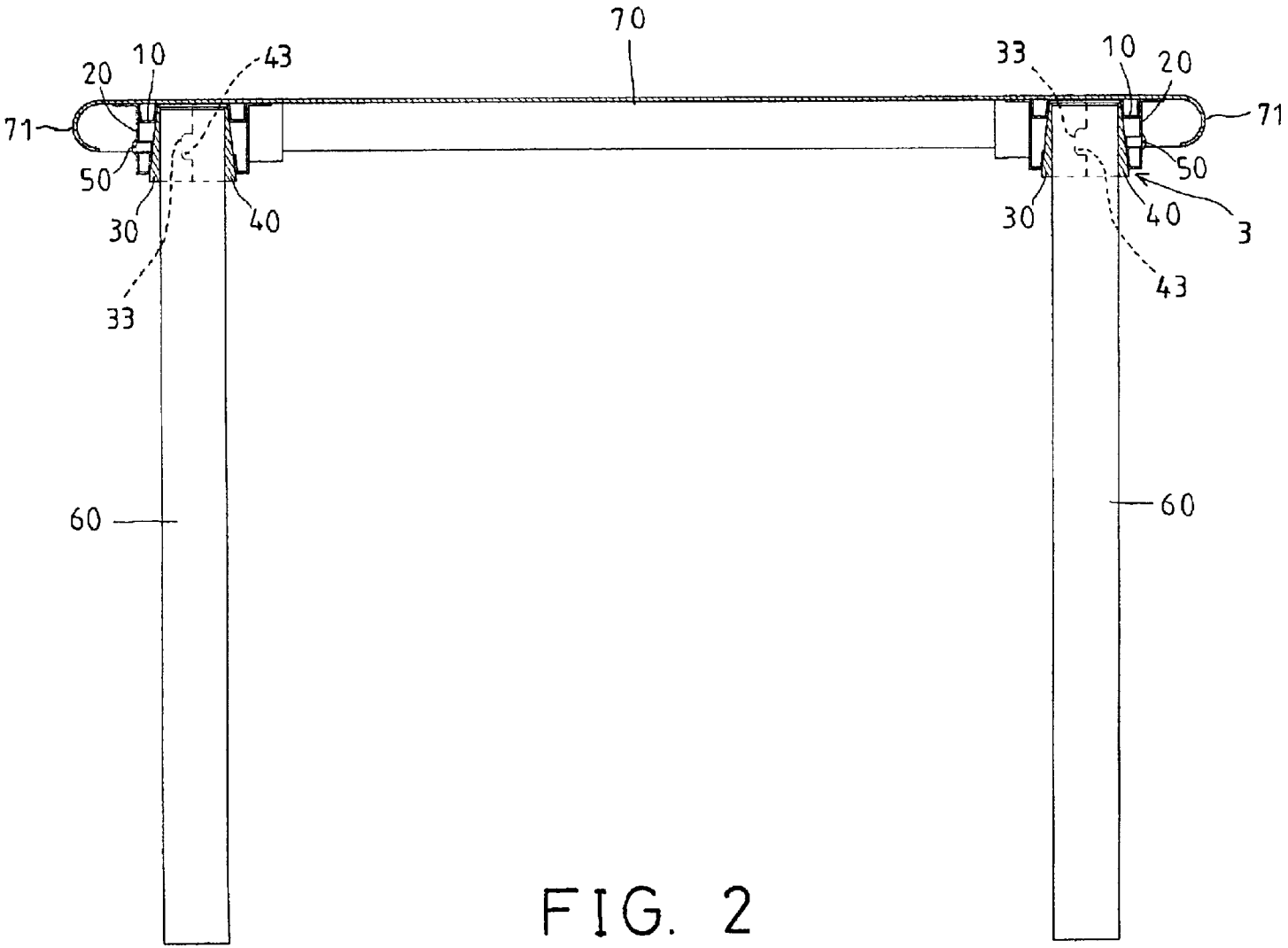
FIG. 2 is a lateral and partial cross sectional view of the worktable.

Referring to the drawings, and initially to FIGS. 1 and 2, a worktable in accordance with the present invention comprises a table top 70 having a rounded outer peripheral portion 71, and one or more legs 60 to be secured to the bottom of the table top 70 with one or more supporting housings 20. The legs 60 each includes one or more peripheral grooves 61 formed in such as the upper portion thereof (FIGS. 1, 3).

Figure 7:
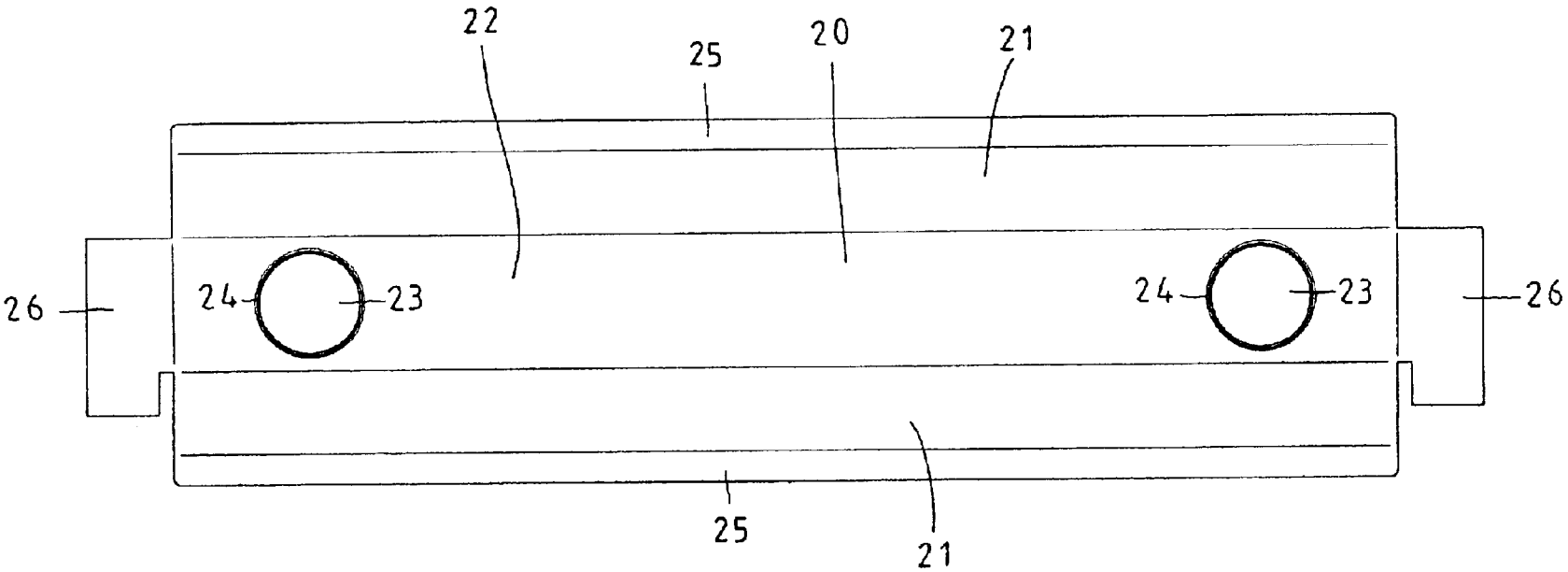
FIG. 7 is a plan view illustrating the sheet material for forming or manufacturing the supporting housing of the worktable.

Referring next to FIGS. 3–7, the supporting housing 20 may be made or formed with a planar or sheet material as shown in FIG. 7, by such as one or more hammering or forging or punching processes, and includes two side walls 21 extended upwardly from a bottom panel 22 and each having a laterally or outwardly extended flange 25 for securing to the bottom of the table top 70 by such as fasteners, adhesive materials, or by welding processes, etc.

The housing 20 includes one or more, such as two orifices 23 formed in the bottom panel 22 thereof, and each formed or defined by a peripheral fence 24 that is extended upwardly from the bottom panel 22 of the housing 20 and extended into a chamber 28 of the housing 20. The housing 20 may include one or more holes 27 formed in either of the side walls 21.

Figure 3:
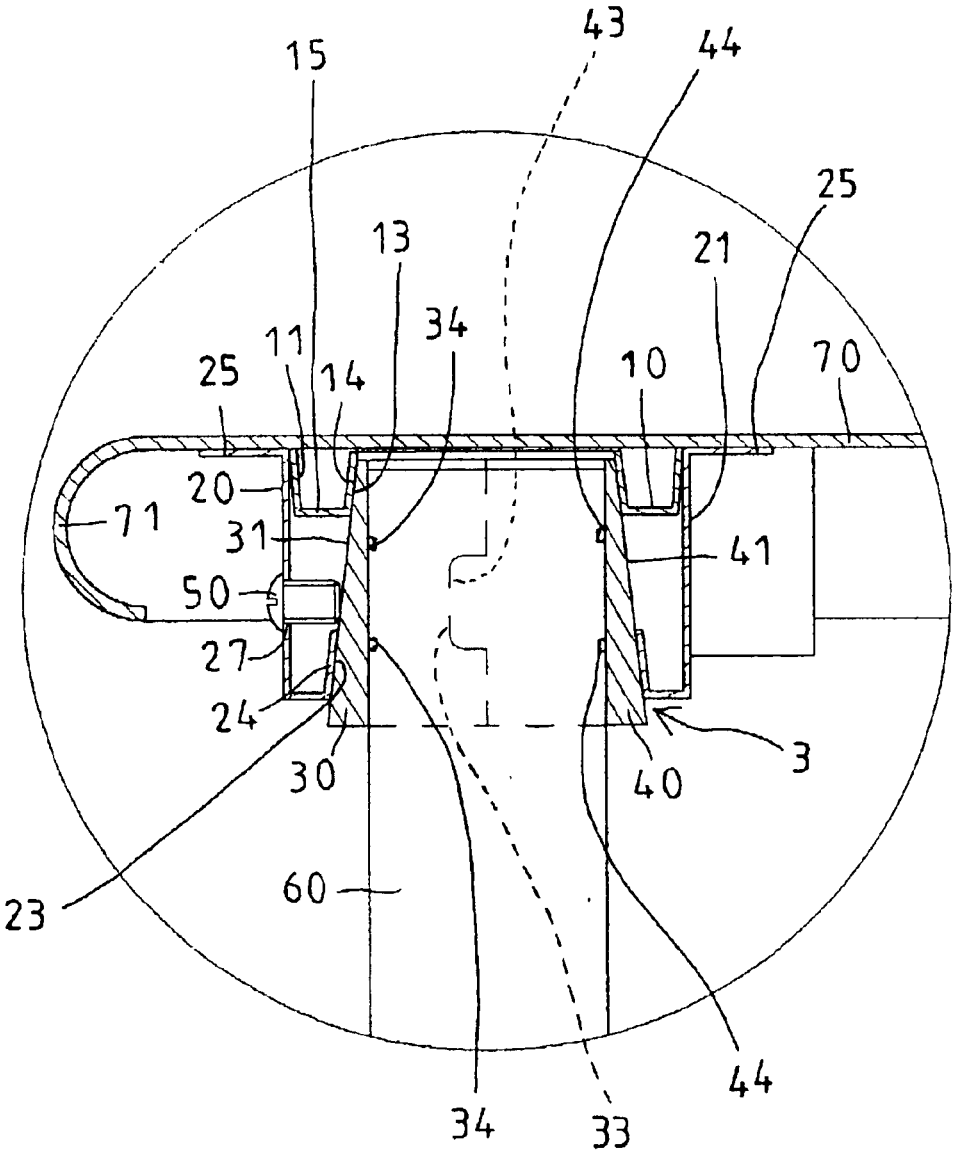
FIG. 3 is an enlarged partial lateral and partial cross sectional view of the worktable.

As best shown in FIG. 3, the peripheral fence 24 includes an inclination or slope, such that the peripheral fence 24 is slightly inclined inwardly into the orifice 23 of the housing 20, and for allowing the orifice 23 of the housing 20 to be formed as a frustum-shaped orifice 23 in the housing 20.

The housing 20 includes two end panels 26 folded or extended upwardly from the ends of the bottom panel 22, for enclosing the two open ends of the housing 20, or the chamber 28 of the housing 20, and for preventing bugs or insects from entering into the chamber 28 of the housing 20.

One or more back-up plates 10 are received in the chamber 28 of the housing 20, and arranged or aligned or disposed above the orifices 23 of the housing 20 respectively. The back-up plates 10 each includes two side flaps 11 extended upwardly from two opposite sides of the bottom panel 15 thereof, and for securing to the side walls 21 of the housing 20 with such as the welding spots 12, or fasteners, or the like.

The back-up plate 10 includes an aperture 13 formed in the bottom panel 15 thereof, and formed or defined by a peripheral fence 14 that is extended upwardly from the bottom panel 15 of the back-up plate 10.

As also shown in FIG. 3, the peripheral fence 14 includes an inclination or slope, such that the peripheral fence 14 is slightly inclined inwardly into the aperture 13 of the back-up plate 10, and for allowing the aperture 13 of the back-up plate 10 to be formed as a frustum-shaped aperture 13 in the back-up plate 10.

Figure 4:
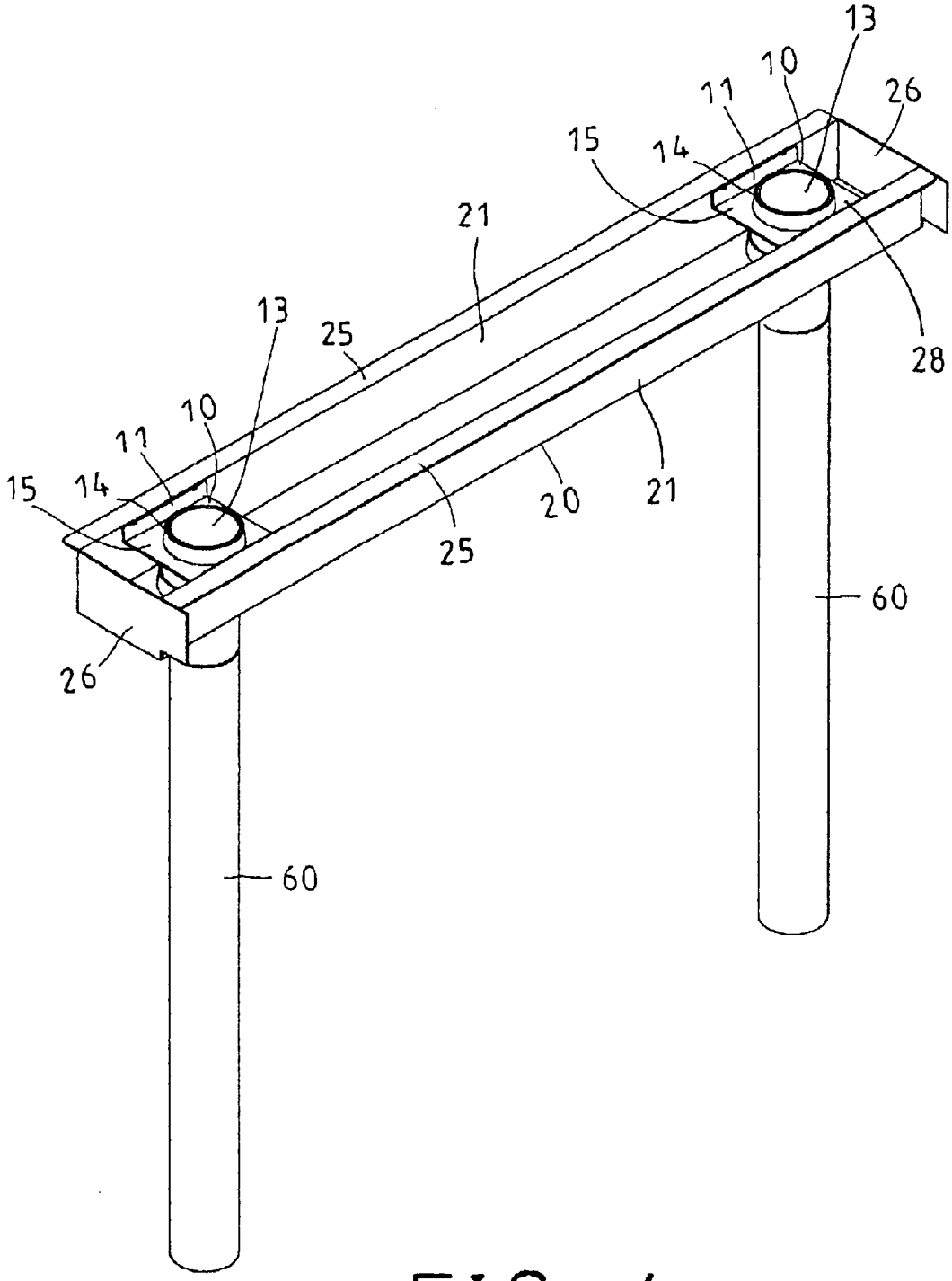
FIG. 4 is a perspective view illustrating two legs and a supporting housing for the worktable.
Figure 5:
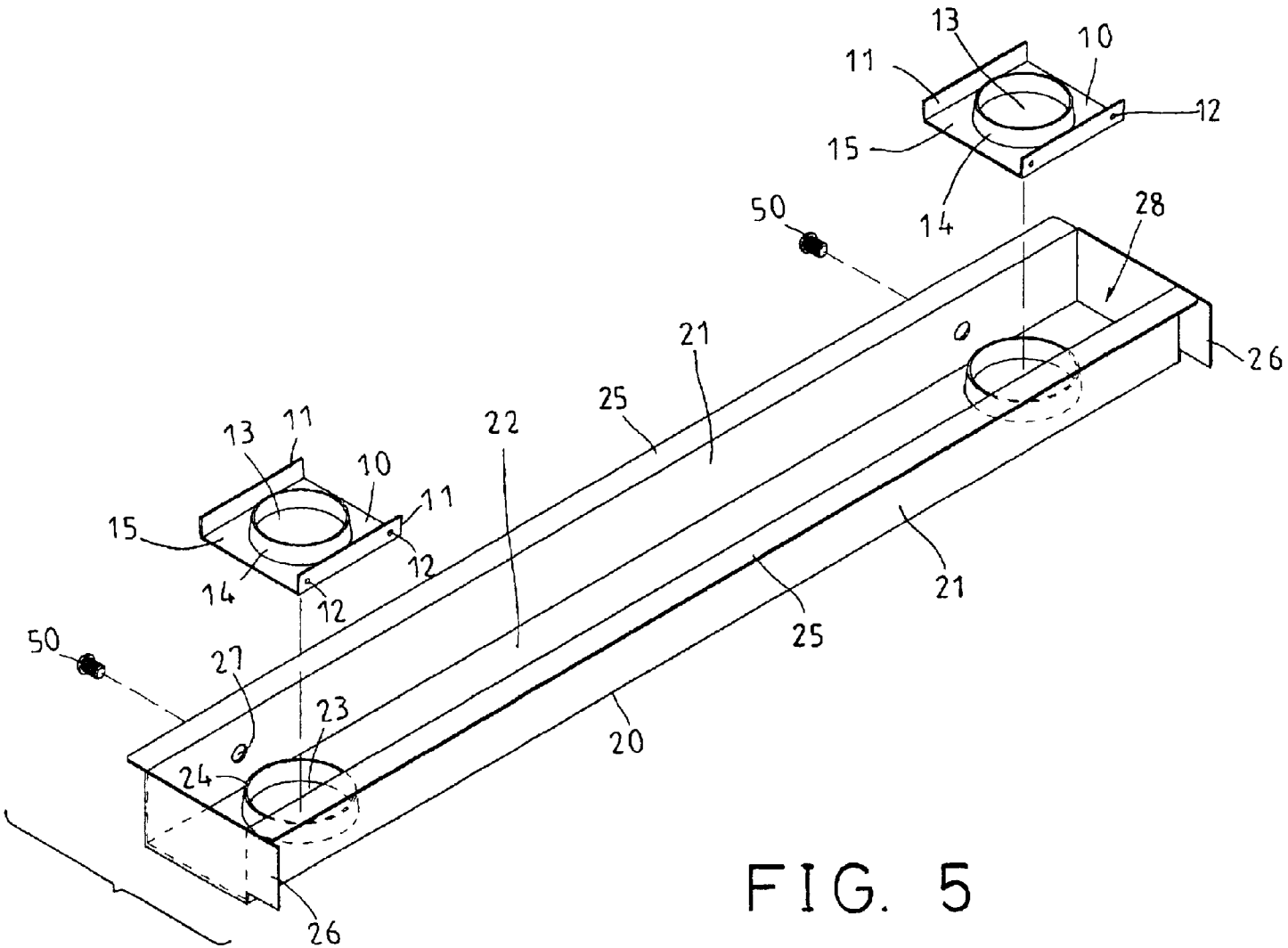
FIG. 5 is an exploded view illustrating the supporting housing for the worktable.
Figure 6:
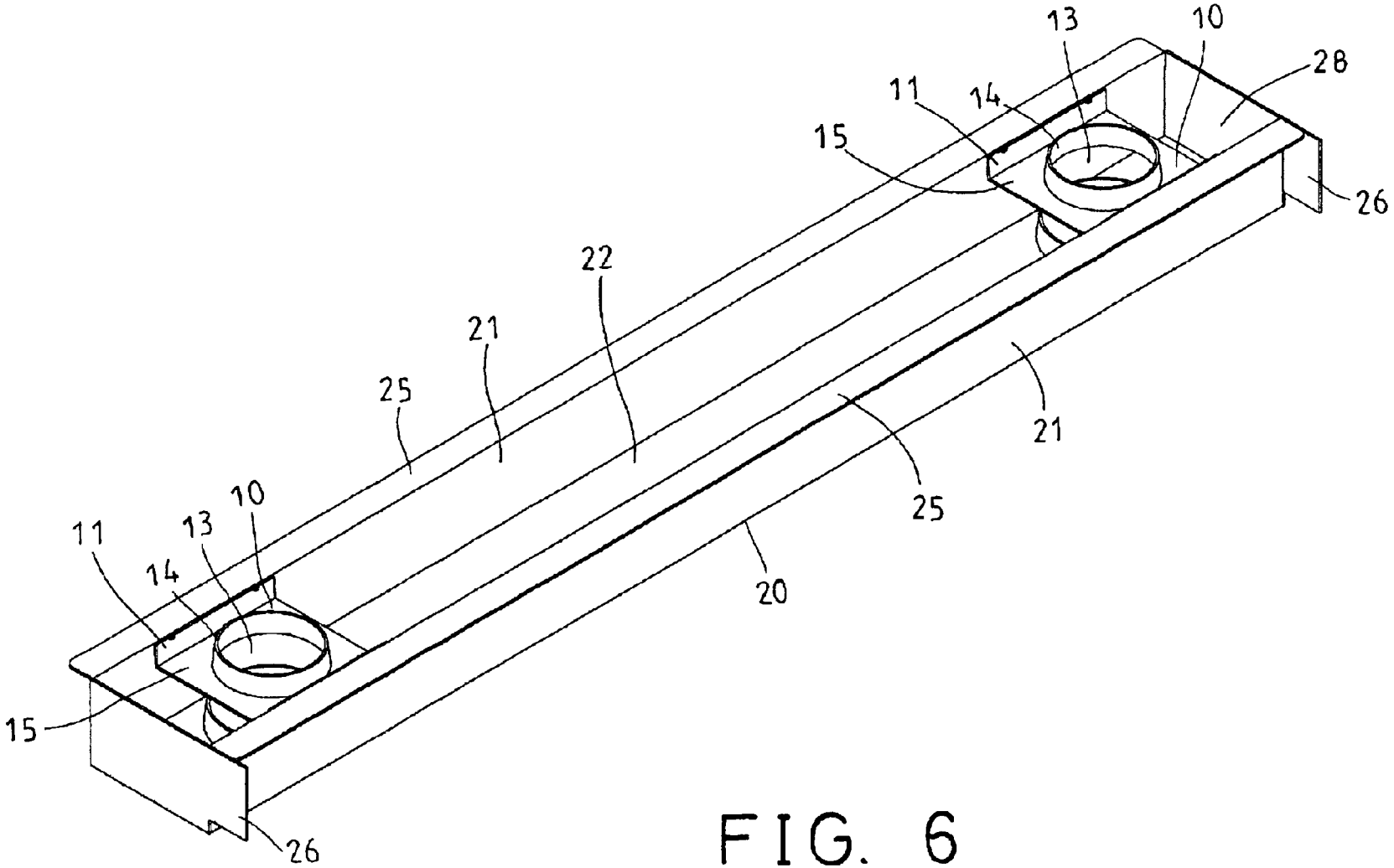
FIG. 6 is a perspective view illustrating the supporting housing for the worktable.

As shown in FIGS. 2–4, the upper portions of the legs 60 are to be engaged into the orifices 23 of the housing 20 and the apertures 13 of the back-up plates 10. A sleeve 3 includes one or more, such as two semi-cylindrical sleeve casings 30, 40 further provided and engaged between the upper portions of the legs 60 and the housing 20 and the back-up plates 10, for forming the cylindrical sleeve 3.

The sleeve casings 30, 40 each preferably includes one or more ribs 34, 44 extended in the inner portion thereof (FIGS. 1, 3) for engaging into the peripheral grooves 61 of the legs 60, and for stably attaching or securing the sleeve casings 30, 40 onto the respective legs 60, and for preventing the sleeve casings 30, 40 from being moved relative to the respective legs 60 As best shown in FIG. 3, the sleeve casings 30, 40 each includes an inclined outer peripheral surface 31, 41 formed thereon and having an inclination or slope, for allowing the sleeve casings 30, 40 and the legs 60 to be easily and solidly engaged into the orifices 23 of the housing 20 and the apertures 13 of the back-up plates 10 respectively.

The inclination of the inclined outer peripheral surface 31, 41 of the sleeve casings 30, 40 may be equal to or slightly greater or smaller than that of the peripheral fences 14, 24 of the housing 20 and the back-up plates 10, for allowing the sleeve casings 30, 40 and the legs 60 to be solidly engaged with the peripheral fences 14, 24 of the housing 20 and the back-up plates 10 by such as a wedge engaging action.

One or more fasteners 50 may optionally or further be provided and threaded with the holes 27 of the housing 20, and engaged with the sleeve casings 30, 40 (FIG. 3), for further solidly securing the sleeve casings 30, 40 to the housing 20 and the back-up plates 10. The legs 60 may also be secured to the housing 20 by the wedge shaped sleeve casings 30, 40, without the fasteners 50.

The sleeve casings 30 each includes one or more, such as two opposite recesses 33 formed therein, such as formed in the sides or ends thereof, and the other sleeve casings 40 each includes one or more, such as two corresponding ears 43 extended therefrom, such as extended from the sides or ends thereof for engaging into the respective recesses 33 of the sleeve casings 30, and for preventing the sleeve casings 30, 40 from moving relative to each other.

The upwardly extended side flaps 11 of the back-up plates 10 may be solidly and firmly secured to the side walls 21 of the housing 20. In addition, the legs 60 may be solidly secured to the housing 20 and the back-up plate 10 with the sleeve casings 30, 40, such that the legs 60 may be solidly secured to the table top 70 with the housing 20 and the plate 10.

Accordingly, the worktable in accordance with the present invention includes a stable structure for allowing the supporting legs to be easily and quickly and solidly secured onto the worktable.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A worktable comprising:

a table top, a housing secured to bottom of said table top, and including a chamber formed therein and defined by a pair of side walls and a bottom panel, said housing including at least one orifice formed in said bottom panel thereof, at least one plate received in said chamber of said housing, and secured between said side walls of said housing, and including an aperture formed therein and aligned with said at least one orifice of said housing, at least one leg including an end portion engaged into said at least one orifice of said housing and said aperture of said at least one plate, and at least one sleeve engaged between said end portion of said at least one leg and said housing and said at least one plate, for securing said at least one leg to said table top with said housing.

2. The worktable according to claim 1, wherein said at least one plate includes two side flaps extended therefrom and secured to said side walls of said housing.

3. The worktable according to claim 1, wherein said at least one plate includes a peripheral fence extended therefrom for forming and defining said aperture thereof and for engaging with said sleeve.

4. The worktable according to claim 3, wherein said peripheral fence of said at least one plate includes an inclination for engaging with said sleeve.

5. The worktable according to claim 3, wherein said sleeve includes an inclined outer peripheral surface for engaging with said peripheral fence of said at least one plate.

6. The worktable according to claim 1, wherein said housing includes a peripheral fence extended from said bottom panel thereof for forming and defining said at least one orifice thereof and for engaging with said sleeve.

7. The worktable according to claim 6, wherein said peripheral fence of said housing includes an inclination for engaging with said sleeve.

8. The worktable according to claim 6, wherein said sleeve includes an inclined outer peripheral surface for engaging with said peripheral fence of said housing.

9. The worktable according to claim 1, wherein said housing includes two open ends, and includes two end panels extended therefrom for enclosing said open ends of said housing.

10. The worktable according to claim 1, wherein said end portion of said at least one leg includes at least one groove formed therein, said sleeve includes at least one rib extended therefrom and engaged into said at least one groove of said at least one leg for preventing said sleeve from moving relative to said at least one leg.

11. The worktable according to claim 1 further comprising means for fastening said sleeve to said housing.

12. The worktable according to claim 1, wherein said sleeve includes two sleeve casings engaged with each other for forming a cylindrical sleeve.

13. The worktable according to claim 12, wherein said end portion of said at least one leg includes at least one groove formed therein, said sleeve casings each includes at least one rib extended therefrom and engaged into said at least one groove of said at least one leg for preventing said sleeve casings from moving relative to said at least one leg.

14. The worktable according to claim 12, wherein a first of said sleeve casings includes at least one recess formed therein, and a second of said sleeve casings includes at least one ear extended therefrom and engaged into said at least one recess of said first sleeve casing, for preventing said first and said second sleeve casings from moving relative to each other.

* * * * *